US006684609B1

(12) United States Patent
Bassissi et al.

(10) Patent No.: US 6,684,609 B1
(45) Date of Patent: Feb. 3, 2004

(54) PACKAGING MACHINE FOR CONTINUOUSLY PRODUCING SEALED PACKAGES OF A POURABLE FOOD PRODUCT, AND HAVING A CAPACITIVE LEVEL SENSOR

(75) Inventors: Fabio Bassissi, Modena (IT); Giorgio Galavotti, Concordia s/S (Modena) (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/546,521

(22) Filed: Apr. 11, 2000

(30) Foreign Application Priority Data

May 14, 1999 (IT) ..... TO99A0409

(51) Int. Cl.[7] ..... B65B 1/36

(52) U.S. Cl. ..... 53/503; 53/52; 53/55; 53/58; 53/451

(58) Field of Search ..... 53/503, 52, 55, 53/58, 504, 451, 450

(56) References Cited

U.S. PATENT DOCUMENTS

| | | | | | |
|---|---|---|---|---|---|
| 3,925,139 | A | * | 12/1975 | Simmons | 156/358 |
| 4,675,660 | A | | 6/1987 | Boscolo | |
| 4,691,496 | A | * | 9/1987 | Anderson et al. | 141/144 |
| 5,009,322 | A | * | 4/1991 | Focke et al. | 131/907 |
| 5,048,335 | A | * | 9/1991 | Marsh et al. | 73/304 C |
| 5,241,804 | A | * | 9/1993 | Tsuruta et al. | 53/504 |
| 5,265,482 | A | | 11/1993 | Davis et al. | |
| 5,388,024 | A | * | 2/1995 | Galvagni | 29/25.42 |
| 5,546,733 | A | | 8/1996 | Paltrinieri | |
| 5,596,150 | A | * | 1/1997 | Arndt et al. | 73/861.12 |
| 5,655,668 | A | * | 8/1997 | Drenth | 209/603 |
| 5,706,627 | A | * | 1/1998 | Kirka et al. | 493/18 |
| 5,973,415 | A | * | 10/1999 | Brenner et al. | 307/118 |
| 6,085,589 | A | * | 7/2000 | Cruickshank | 73/290 R |

FOREIGN PATENT DOCUMENTS

| | | |
|---|---|---|
| EP | 0518237 | 12/1992 |
| EP | 0681961 B1 | 10/1997 |

* cited by examiner

*Primary Examiner*—Eugene Kim
*Assistant Examiner*—Christopher Harmon
(74) *Attorney, Agent, or Firm*—Burns, Doane, Swecker & Mathis, L.L.P.

(57) ABSTRACT

A packaging machine (1) for continuously producing sealed packages (2) of a pourable food product from a tube (4) of heat-seal sheet packaging material fed along a vertical path (A) and filled continuously with the food product by means of a fill conduit (8) extending inside the tube (4). The packaging machine (1) has a capacitive level sensor (14) located outside the tube (4) and in turn having a plate element (20) made of conducting material, positioned facing the fill conduit (8), and defining, together with the fill conduit (8), a capacitive element (22) whose capacitance depends, among other things, on the amount of food product between its plates. The level sensor (14) also has a detecting circuit (24) connected to and for detecting the capacitance of the capacitive element (22), and generating a level signal (SL) indicating the level of the food product inside the tube (4).

6 Claims, 2 Drawing Sheets

PACKAGING MACHINE FOR CONTINUOUSLY PRODUCING SEALED PACKAGES OF A POURABLE FOOD PRODUCT, AND HAVING A CAPACITIVE LEVEL SENSOR

The present invention relates to a packaging machine for continuously producing sealed packages of a pourable food product, and having a capacitive level sensor.

Many pourable food products, such as fruit juice, UHT milk, wine, tomato sauce, etc., are sold in packages made of sterilized packaging material.

A typical example of such a package is the parallelepiped-shaped package for liquid or pourable food products known as Tetra Brik or Tetra Brik Aseptic (registered trademarks), which is formed by folding and sealing laminated strip packaging material. The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of barrier material defined, for example, by an aluminium film, which is superimposed on a layer of heat-seal plastic material and is in turn covered with another layer of heat-seal plastic material eventually defining the inner face of the package contacting the food product.

As is known, such packages are made on fully automatic packaging units, on which a continuous tube is formed from the packaging material supplied in strip form; the strip of packaging material is sterilized on the packaging unit itself, e.g. by applying a chemical sterilizing agent, such as a hydrogen peroxide solution, which, after sterilization, is removed, e.g. vaporized by heating, from the surfaces of the packaging material; and the strip of packaging material so sterilized is maintained in a closed sterile environment, and is folded and sealed longitudinally to form a tube.

The tube is filled with the sterilized or sterile-processed food product, and is sealed and cut at equally spaced cross sections to form pillow packs, which are then folded mechanically to form the finished, e.g. substantially parallelepiped-shaped, packages.

More specifically, the food product is fed from the usual storage tank into the tube of packaging material along a fill conduit extending inside the tube of packaging material and having a flow-regulating solenoid valve.

To ensure a substantially constant level of the food product inside the tube of packaging material during formation of the packages, known packaging machines are also normally provided with level-maintaining devices comprising a level sensor for determining the level of the food product inside the tube; and a control device for controlling the flow-regulating solenoid valve, and operating on the basis of the signal from the level sensor.

Numerous types of level sensors are known. Some feature a float housed inside the tube of packaging material, and the position of which is determined either by means of mechanical devices also housed inside the tube of packaging material, or by means of Hall-effect sensors located outside the tube of packaging material and which detect the presence of magnetic elements carried by the float.

Another type features a conducting rod partly immersed in the food product inside the tube of packaging material, and the exposed end of which is connected to an electric circuit located outside the tube, and to which the fill conduit is also connected. In this solution, the food product, being conductive, electrically connects the immersed portion of the rod and the fill conduit, which are thus connected in series within the electric circuit to which they are connected; and, since the actual resistance of the rod, and hence the values of electric quantities in the circuit, such as current flow, depend on the level of the food product inside the tube of packaging material, this is therefore determined on the basis of the values of said electric quantities.

Another type of level sensor is described, for example, in U.S. Pat. No. 4,675,660 filed by TETRA DEV-CO Consorzio di Studio e Ricerca Industriale, and operates on the principle of creating energy waves inside the fill conduit using a transducer housed inside the tube of packaging material and contacting the fill conduit. The energy waves are transmitted to the food product inside the tube of packaging material, and may therefore be detected and so converted as to indicate the level of the food product inside the tube of packaging material.

A common drawback of all the level sensors described above is the use of components—such as floats, mechanical devices, rods, transducers—housed inside the tube of packaging material, and which, being in contact with the food product for packaging; require regular thorough cleaning to ensure strictly hygienic packaging conditions.

Moreover, on account of the form and location of the components inside the tube of packaging material, the actual cleaning operation is often a long, painstaking job.

European Patent EP-B1-0681961, filed by the present Applicant, describes a level sensor designed to eliminate the aforementioned drawback typically associated with level sensors of the type described above.

The level sensor in question operates on the principle of determining the level of the food product inside the tube of packaging material using a temperature-detecting device located outside the tube of packaging material and comprising a number of temperature sensors located successively along the tube; and the level of the food product inside the tube of packaging material is determined on the basis of the relationship between the number of temperature sensors detecting a surface temperature of the tube affected by the food product, and the number of temperature sensors detecting a surface temperature of the tube not affected by the food product.

Featuring a large number of temperature sensors, however, the level sensor described in the above patent is fairly complex, both to produce and in terms of computation, by requiring more or less complex processing of the various temperature sensor signals.

Moreover, using the above level sensor, the flow-regulating solenoid valve is controlled, not in real time, but with a certain delay correlated to the thermal inertia of the packaging material of the tube. That is, since the intrinsic thermal inertia of the packaging material is other than zero, the effect of a variation in food product level on the temperature of the tube, as opposed to be being determined in real time by the temperature sensors, can only be determined some time after the instant in which it occurs, thus inevitably also affecting control of the flow-regulating solenoid valve and of the food product level.

It is an object of the present invention to provide a packaging machine featuring a level sensor located outside the tube of packaging material, and which is straightforward and cheap to produce, and provides for real-time detecting variations in food product level.

According to the present invention, there is provided a packaging machine for continuously producing sealed packages of a pourable food product from a tube of heat-seal sheet packaging material fed along a vertical path and filled continuously with said food product by means of a fill conduit extending inside said tube; said packaging machine comprising level-sensor means for detecting the level of said food product inside said tube; and being characterized in that said level-sensor means comprise capacitive level-sensor means located outside said tube.

A preferred, non-limiting embodiment of the present invention will be described by way of example with reference to the accompanying drawings, in which.

Figure 1:
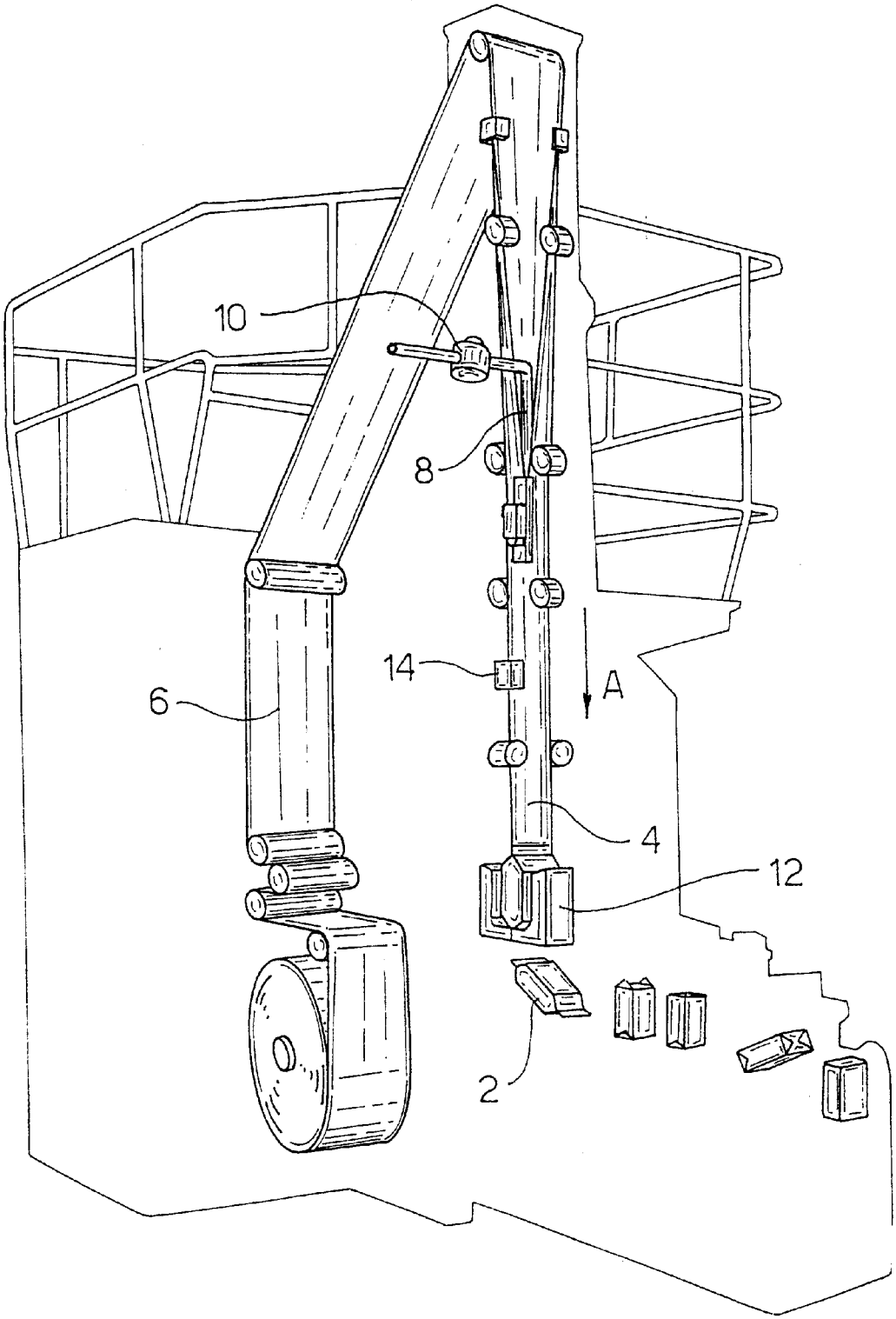
FIG. 1 shows a view in perspective, with parts removed for clarity, of a known packaging machine for producing aseptic sealed packages of pourable food products from a tube of packaging material.

Number 1 in FIG. 1 indicates as a whole a packaging machine for producing sealed packages 2 of a pourable food product, such as pasteurized or UHT milk, fruit juice, wine, etc., from a tube 4 of packaging material.

The packaging material has a multilayer structure (not shown), and comprises a layer of fibrous material, normally paper, covered on both sides with respective layers of heat-seal plastic material, e.g. polyethylene.

Tube 4 is formed in known manner—therefore not described in detail—by longitudinally folding and sealing a strip 6 of heat-seal sheet material, is filled with the sterilized or sterile-processed food product by means of a fill conduit 8 extending inside tube 4 and having a flow-regulating solenoid valve 10, and is fed by known devices along a vertical path A to a forming station 12, where it is cut transversely and folded mechanically to form packages 2.

Packaging machine 1 also comprises a capacitive level sensor 14, which is located outside tube 4, is positioned facing an end portion of fill conduit 8, is located upstream from forming station 12, and is supported in said position by an arm not shown.

Figure 2:
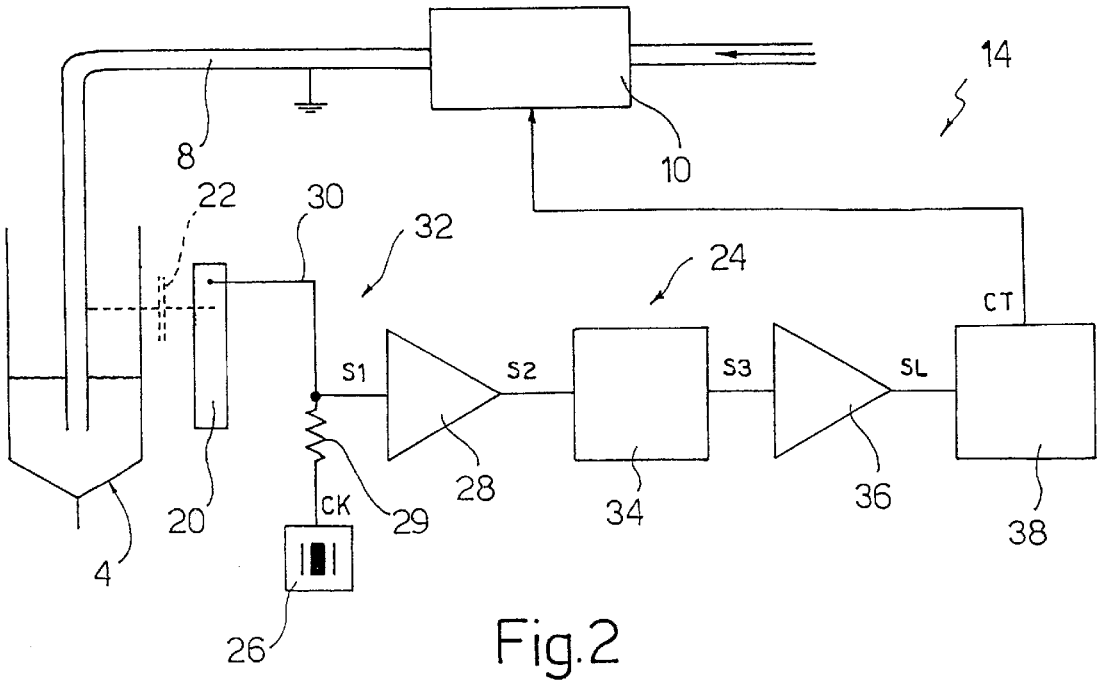
FIG. 2 shows, schematically, a level sensor in accordance with the present invention, and the portion of the FIG. 1 packaging machine in which the level sensor is located.

FIG. 2 shows a detail of the circuit structure of the level sensor, wherein any parts in common with FIG. 1 are indicated using the same reference numbers.

As shown in FIG. 2, level sensor 14 comprises a plate element 20 made of electrically conductive material, located outside tube 4 facing a portion of fill conduit 8, and defining, together with the facing fill conduit 8, a capacitive element—shown by the dash line and indicated 22 in FIG. 2—whose capacitance depends, not only on the geometric dimensions of plate element 20 and the distance between plate element 20 and fill conduit 8, but also on the dielectric interposed between its plates, and therefore, among other things, also on the amount of food product between the plates.

Preferably, plate element 20 is made of brass, is located about 2 mm from tube 4, and is in the form of an elongated, substantially rectangular 18×2 cm strip.

Level sensor 14 also comprises a detecting circuit 24 connected to and for detecting the capacitance of capacitive element 22.

More specifically, detecting circuit 24 comprises a quartz oscillator 26 generating, at an output terminal, a periodic, typically sinusoidal, clock signal CK of 1 MHz frequency and a predetermined peak-to-peak amplitude; and a high-input-impedance amplifier 28 having an input terminal connected to the output terminal of oscillator 26 via a resistor 29, and to plate element 20 by a conductor 30, and receiving a first periodic intermediate signal S1 of a peak-to-peak amplitude correlated—as described in detail later on—to the amplitude and frequency of clock signal CK, to the geometric dimensions of plate element 20, to the resistance of resistor 29, and to the presence or absence of food product between plate element 20 and fill conduit 8. Amplifier 28 also has an output terminal supplying a second intermediate signal S2 proportional to the first intermediate signal S1 via an amplification factor.

Capacitive element 22 is thus connected between the input terminal of amplifier 28 and ground (electric potential of fill conduit 8), and defines, together with resistor 29, an RC-type filtration network 32 interposed between the output terminal of oscillator 26 and the input terminal of amplifier 28, which substantially acts as a decoupling element to disconnect plate element 20 from the rest of the electric circuit downstream, and so prevent the latter from altering the characteristics of filtration network 32.

Detecting circuit 24 also comprises a peak detector 34 having an input terminal connected to the output terminal of amplifier 28 and receiving second intermediate signal S2, and an output terminal supplying a third intermediate signal S3 indicating the peak-to-peak amplitude of second intermediate signal S2 at the input; and an amplifier 36 having an input terminal connected to the output of peak detector 34 and receiving third intermediate signal S3, and an output terminal supplying a level signal SL indicating the level of the food product inside tube 4.

More specifically, amplifier 36 is defined by an operational amplifier operating as an inverting adder with offset and gain control, i.e. which inverts third intermediate signal S3 and adds an adjustable offset value to it; and level signal SL is an analog signal varying continuously between a minimum and maximum value, e.g. between 0 and 10 V, respectively indicating no food product between plate element 20 and fill conduit 8—and therefore a food product level below plate element 20—and the presence of enough food product between plate element 20 and fill conduit 8 to completely fill the volume in between—and therefore a food product level above plate element 20.

Packaging machine 1 also comprises a control circuit 38 having an input terminal connected to the output terminal of amplifier 36 to receive level signal SL, and an output terminal supplying a control signal CT, which is supplied to flow-regulating solenoid valve 10 and determined in known manner, not described in detail, as a function of the level signal to regulate food product flow into tube 4 according to the information relative to the food product level inside tube 4.

Level sensor 14 operates as follows.

As the food product level inside tube 4 rises, the volume of tube 4 between plate element 20 and the facing portion of fill conduit 8 gradually fills up, so as to gradually increase the capacitance of capacitive element 22 produced by the presence of food product between its plates.

That is, the increase in the amount of food product between the plates of capacitive element 22 can be viewed either as the plates of capacitive element 22 being brought gradually closer together, or as the presence, in parallel with capacitive element 22, of a further capacitive element, the dielectric of which is defined by the food product.

Whichever the case, as the food product level inside tube 4 rises, the capacitance of capacitive element 22 increases gradually from a minimum value assumed with no food product between the plates, to a maximum value assumed when the food product completely fills the volume of tube 4 between plate element 20 and the facing portion of fill conduit 8, i.e. when the food product level is above plate element 20.

Since plate element 20, however, is supplied with clock signal CK of constant frequency—1 MHz in the example shown—the gradual increase in the capacitance of capacitive element 22 is accompanied by a gradual reduction in its capacitive reactance and, hence, an increase in the cutoff frequency of filtration network 32.

The gradual increase in cutoff frequency produces a gradual reduction in the peak-to-peak amplitude of first intermediate signal S1 at the input terminal of amplifier 28, so that the peak-to-peak amplitude of second intermediate signal S2 at the output terminal of amplifier 28 decreases gradually from a maximum value assumed with no food product between the plates of capacitive element 22, to a minimum value assumed when the food product completely fills the volume of tube 4 between plate element 20 and fill conduit 8.

The fall in the peak-to-peak amplitude of second intermediate signal S2 is detected by peak detector 34, the output terminal of which therefore supplies third intermediate signal S3, the amplitude of which is correlated to the peak-to-peak amplitude of second intermediate signal S2 and therefore decreases gradually as the food product level inside tube 4 rises.

Third intermediate signal S3 is supplied to amplifier 36, which, operating as an inverting adder with a predetermined offset, generates a level signal, the amplitude of which, as the food product level inside tube 4 rises, increases gradually from a minimum value assumed with no food product between the plates of capacitive element 22, to a maximum value assumed when the food product completely fills the volume of tube 4 between plate element 20 and the facing portion of fill conduit 8.

The level signal is supplied to control circuit 38, which accordingly generates control signal CT to control flow-regulating solenoid valve 10.

Figure 3:
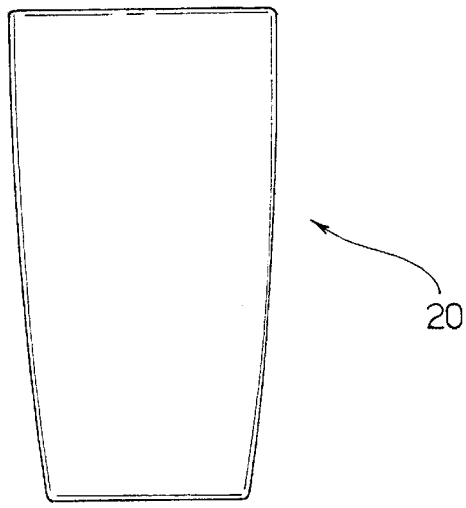
FIG. 3 shows a front view of a conductive plate element forming part of the FIG. 2 level sensor.

According to a further aspect of the present invention, to achieve a linear relationship between the speeds at which level signal SL and the food product level inside tube 4 increase, plate element 20 is appropriately shaped as shown in FIG. 3.

More specifically, as shown in FIG. 3, plate element 20, viewed from the front, has a substantially trapezoidal profile with the major base at the top and slightly outwardly-convex oblique sides.

The advantages of the packaging machine according to the present invention will be clear from the foregoing description.

In particular, the capacitive level sensor described above has no components housed inside the tube of packaging material, thus enabling packaging to a high standard of hygiene, as well as simplifying cleaning of the packaging machine.

Moreover, the capacitive level sensor according to the present invention is easy and therefore cheap to produce, and supplies a signal requiring no complex processing by the control circuit generating the flow-regulating solenoid valve control signal.

Moreover, working on variations in capacitance as opposed to temperature, the capacitive level sensor according to the present invention provides for real-time detecting variations in product level and, consequently, for real-time control of the flow-regulating solenoid valve.

Clearly, changes may be made to the packaging machine as described and illustrated herein without, however, departing from the scope of the present invention.

What is claimed is:

1. A packaging machine for continuously producing sealed packages of pourable food product from a packaging tube of heat-sealable sheet packaging material, said packaging tube of heat-sealable sheet packaging material being fed along a vertical path within said packaging machine and said packaging tube of heat-sealable sheet packaging material being filled continuously with a food product thereby defining a level of food product inside said packaging tube of heat-sealable sheet packaging material, said packaging machine comprising:

a fill conduit disposed within said packaging machine, said fill conduit extending inside said packaging tube of heat-sealable sheet packaging material;

a capacitive level sensor means disposed within said packaging machine, said capacitive level sensor means being located outside said tube for detecting said level of food product inside said packaging tube of heat-sealable sheet packaging material;

a flow-regulating means for controlling flow of said food product through said fill conduit into said packaging tube of heat-sealable sheet packaging material wherein said capacitive level sensor means comprises:

a plate element made of conducting material, said plate element being located outside said packaging tube of heat-sealable sheet packaging material, said plate element being separated from said fill conduit and facing said fill conduit;

a capacitive element defined by said plate element and said fill conduit, said capacitive element having a capacitance correlated to an amount of said food product inside said packaging tube of heat-sealable sheet packaging material between said plate element and said fill conduit;

a detecting means coupled with said capacitive element for detecting said capacitance, said detecting means having an output, said detecting means providing a level signal at said output indicating said level of food product inside said tube; and a control circuit, said control circuit receiving said level signal from said output and generating a control signal, said control signal controlling said flow regulating means and said level of food product inside said packaging tube of heat-sealable sheet packaging material.

2. A packaging machine as recited in claim 1, wherein said plate element has a substantially trapezoidal shape for creating a linear relationship between speeds of increase of said level signal and said level of food product inside said packaging tube of heat-sealable sheet packaging material.

3. A packaging machine as set forth in claim 1, wherein the control signal controls said flow regulating means and said level of food product inside said packaging tube of heat-sealable sheet packaging material based on the level of food product inside the tube.

4. A packaging machine for continuously producing sealed packages of pourable food product from a packaging tube of heat-sealable sheet packaging material, said packaging tube of heat-sealable sheet packaging material being fed along a vertical path within said packaging machine and said packaging tube of heat-sealable sheet packaging material being filled continuously with a food product thereby defining a level of food product inside said packaging tube of heat-sealable sheet packaging material, said packaging machine comprising:

a fill conduit disposed within said packaging machine, said fill conduit extending inside said packaging tube of heat-sealable sheet packaging material;

a capacitive level sensor means disposed within said packaging machine, said capacitive level sensor means being located outside said tube for detecting said level of food product inside said packaging tube of heat-sealable sheet packaging material;

a flow-regulating means for controlling flow of said food product through said fill conduit into said packaging tube of heat-sealable sheet packaging material wherein said capacitive level sensor means comprises:

a plate element made of conducting material, said plate element being located outside said packaging tube of heat-sealable sheet packaging material, said plate element being separated from said fill conduit, said plate element facing said fill conduit and being shaped for creating a linear relationship between speeds of increase of said level signal and said level of food product inside said packaging tube of heat-sealable sheet packaging material;

a capacitive element defined by said plate element and said fill conduit, said capacitive element having a capacitance correlated to an amount of said food product inside said packaging tube of heat-sealable sheet packaging material between said plate element and said fill conduit;

a detecting means coupled with said capacitive element for detecting said capacitance, said detecting means having an output, said detecting means providing a level signal at said output indicating said level of food product inside said tube; and a control circuit, said control circuit receiving said level signal from said output and generating a control signal, said control signal controlling said flow regulating means and said level of food product inside said packaging tube of heat-sealable sheet packaging material.

5. A combination according to claim 4, wherein said plate element has a substantially trapezoidal shape for creating said linear relationship between speeds of increase of said level signal and said level of said food product inside said packaging tube of heat-sealable sheet packaging material.

6. A packaging machine as set forth in claim 4, wherein the control signal controls said flow regulating means and said level of food product inside said packaging tube of heat-sealable sheet packaging material based on the level of food product inside the tube.

* * * * *